US005964163A

United States Patent [19]

Cohen

[11] Patent Number: 5,964,163

[45] Date of Patent: Oct. 12, 1999

[54] SHELVING SYSTEM

[75] Inventor: Rowi Cohen, Moshav Bwey Atarot, Israel

[73] Assignee: ZAG Industries Ltd., Rosh Ha'Ayin, Israel

[21] Appl. No.: 09/004,297

[22] Filed: Jan. 8, 1998

Related U.S. Application Data

[63] Continuation-in-part of application No. 08/985,784, Dec. 5, 1997.

[51] Int. Cl.[6] ..... A47B 3/00

[52] U.S. Cl. ..... 108/91; 108/186; 108/901; 108/25; 211/188; 211/119.003; 206/326

[58] Field of Search ..... 108/14, 18, 53.3, 108/91, 106, 107, 186, 190, 147.12, 147.13, 147.11, 110, 151, 156, 157.13, 158.11, 901, 25, 26; 211/188, 186, 187, 119.003, 86.01; 206/326

[56] References Cited

U.S. PATENT DOCUMENTS

| | | | |
|---|---|---|---|
| 3,420,484 | 1/1969 | Mattick | 108/156 X |
| 4,138,953 | 2/1979 | Tashman | 108/147.13 |
| 4,158,336 | 6/1979 | Brescia et al. | 108/156 X |
| 4,696,406 | 9/1987 | Karashima | 108/110 X |
| 4,706,576 | 11/1987 | James | 108/107 X |
| 4,976,360 | 12/1990 | Zucker et al. | 108/190 X |

FOREIGN PATENT DOCUMENTS

| | | | |
|---|---|---|---|
| 93/12692 | 7/1993 | WIPO | 108/18 |

*Primary Examiner*—Peter M. Cuomo
*Assistant Examiner*—Janet M. Wilkens
*Attorney, Agent, or Firm*—Pillsbury Madison & Sutro LLP

[57] ABSTRACT

A shelving system adapted for compact packaging has a number of shelves of molded polymer material. Each shelf has at least two hollow support ribs of height h extending parallel to a width of the shelf, and at least one intermediate platform portion connecting between the support ribs. The intermediate platform portion has a height significantly less than h such that a first and a second of the shelves can be positioned in an interlocking storage configuration with at least one of the support ribs of the first shelf adjacent to the intermediate platform portion of the second shelf so as to form a compact shelf-pair package.

19 Claims, 19 Drawing Sheets

SHELVING SYSTEM

This application is a continuation-in-part of Ser. No. 08/985,784 entitled Shelving System filed Dec. 5, 1997.

FIELD AND BACKGROUND OF THE INVENTION

The present invention relates to shelving systems and, in particular, it concerns a molded plastic shelving system in which the shelves are formed from open ended structures with suspension inserts.

It is known to construct shelves systems from molded plastic. Typically, such systems have a number of shelves supported at their corners by four upright poles. The poles may be constructed from segments to allow them to be packed compactly. The shelves are typically reinforced with various ribs and the like, especially along their longest dimension.

It is known in the art that the strongest support structures are those having a closed cross-section. Closed support structures require molding techniques in which elongated mold parts move along the length of the supports. However, suspension of shelves on upright poles typically requires precisely molded vertical apertures which necessitate a vertical mold movement. As a result, conventional plastic shelves are limited to the use of weaker open support structures.

An additional shortcoming of existing shelf systems is that they occupy a large volume for packaging and storage. The minimum size for a packaged shelf system is typically the sum of the external dimensions of all the shelves plus the volume occupied by the support rods and any other fittings which do not fit between the shelves.

There is therefore a need for a strong, molded-plastic shelving system which has a highly compact storage configuration.

SUMMARY OF THE INVENTION

The present invention is a strong, molded-plastic shelving system which has a highly compact storage configuration.

According to the teachings of the present invention there is provided, a shelving system adapted for compact packaging comprising a plurality of shelves of molded polymer material, each of the shelves having at least two hollow support ribs extending parallel to, and along substantially the entirety of, a width of the shelf, the hollow support ribs having a height h, each of the shelves further including at least one intermediate platform portion connecting between the support ribs, the at least one intermediate platform portion having a height significantly less than h such that a first shelf and a second shelf from the plurality of shelves can be positioned in an interlocking storage configuration in which at least one of the support ribs of the first shelf adjacent to the intermediate platform portion of the second shelf so as to form a compact shelf-pair package having a total height less than 2×h.

According to a farther feature of the present invention, the total height is less than about 1.5×h, and preferably less than about 1.3×h.

According to a further feature of the present invention, there is also provided a plurality of rods for supporting the plurality of shelves in spaced relation, at least one of the hollow support ribs of each of the shelves having an elongated internal cavity, the elongated internal cavity and the rods being configured such that each of the rods can be introduced into the elongated cavity to a storage position in which the rod is substantially fully inserted within the elongated internal cavity.

According to a further feature of the present invention, the elongated internal cavity extends along the entire length of the hollow support ribs such that the rod can pass freely through the hollow support rib.

According to a further feature of the present invention, the rods have a length, the elongated internal cavity having an internal stop deployed so as to delimit a fully inserted storage position of the rods within the hollow support ribs such that the rods extend slightly from the hollow support rib.

According to a further feature of the present invention, there is also provided, for each of the shelves, a plurality of compound plug elements, each of the compound plug elements being formed from at least two plug sections which assume a substantially separated state for compact storage and an interconnected state configured for engaging an open end of one of the hollow support ribs.

According to a further feature of the present invention, the at least two plug sections are integrally formed from molded polymer material so as to connected by an integral hinge element in the substantially separated state.

According to a further feature of the present invention, there are also provided a number of side cover elements each configured to receive at least two of the compound plug elements so as to form a cover unit for attaching to a side of one of the shelves.

According to a farther feature of the present invention, each of the support ribs provides an opening through an upper surface of the shelf adjacent to ends of the shelf, each of the compound plug elements having a vertical bore configured so as to be aligned with the opening when the compound plug is engaged within an open end of one of the hollow support ribs.

According to a further feature of the present invention, there is also provided a reinforcing element configured for attachment between the lower surfaces of at least two of the support ribs in a direction perpendicular to the extensional direction of the support ribs so as to oppose increase of a distance between the support ribs.

According to a farther feature of the present invention, the reinforcing element features a plurality of barbed projections for engaging corresponding holes in the support ribs.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a shelving system.

The principles and operation of systems according to the present invention may be better understood with reference to the drawings and the accompanying description.

Figure 1:
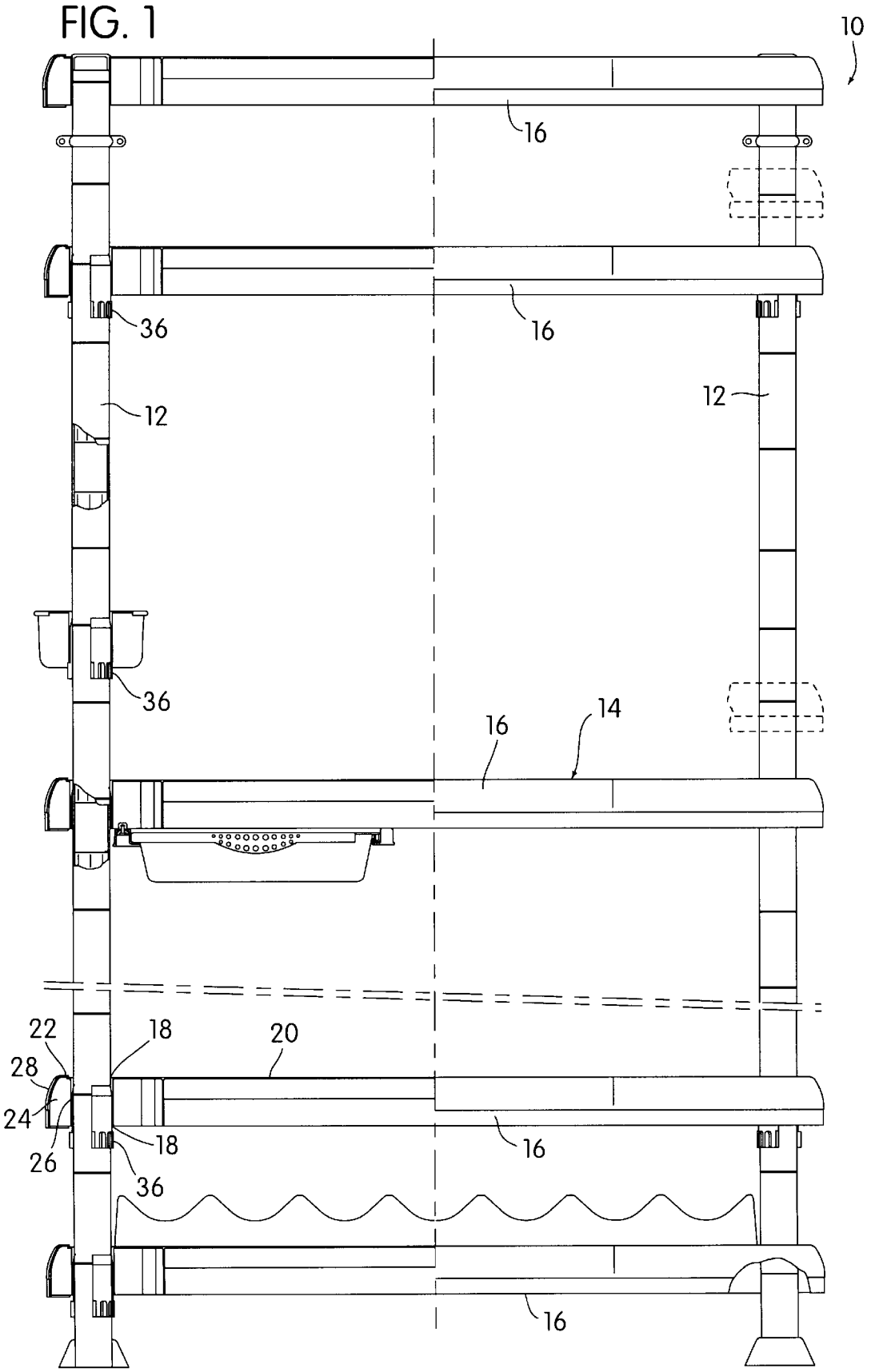
FIG. 1 is a partially cut-away front view of a shelving system, constructed and operative according to the teachings of the present invention.

Referring now to the drawings, FIG. 1 shows a first embodiment of a shelving system, generally designated 10, constructed and operative according to the teachings of the present invention. Generally speaking, shelving system 10 features two spaced apart pairs of support rods 12 deployed substantially vertically with a number of shelf assemblies 14 supported thereby. Each shelf assembly 14 is constructed from an open ended, molded polymer shelf 16 having two openings 18 in the upper surface 20 adjacent to each of the open ends 22, and two suspension inserts 24 engageable within open ends 22. Each suspension insert 24 has a pair of vertical bores 26, aligned with openings 18 when assembled, which are configured for forming suspension joints with support rods 12. Where shelf 16 also has a lower surface adjacent to open ends 22, openings 18 are also provided through the lower surface.

It will be readily apparent that the shelf assembly structure described provides major advantages. Since the precision vertical bores are contained within the separate suspension inserts, the main body of the shelf can be molded by techniques employing primarily longitudinal movement of mold parts, i.e., along the longest dimension of the shelves. Thus, in a preferred embodiment, each shelf is formed with support elements of closed cross-section extending along most or all of its length. As mentioned above, such a structure cannot be achieved by the direct molding techniques of the prior art which must produce precision vertical bores through a singe shelf element.

Figure 2:
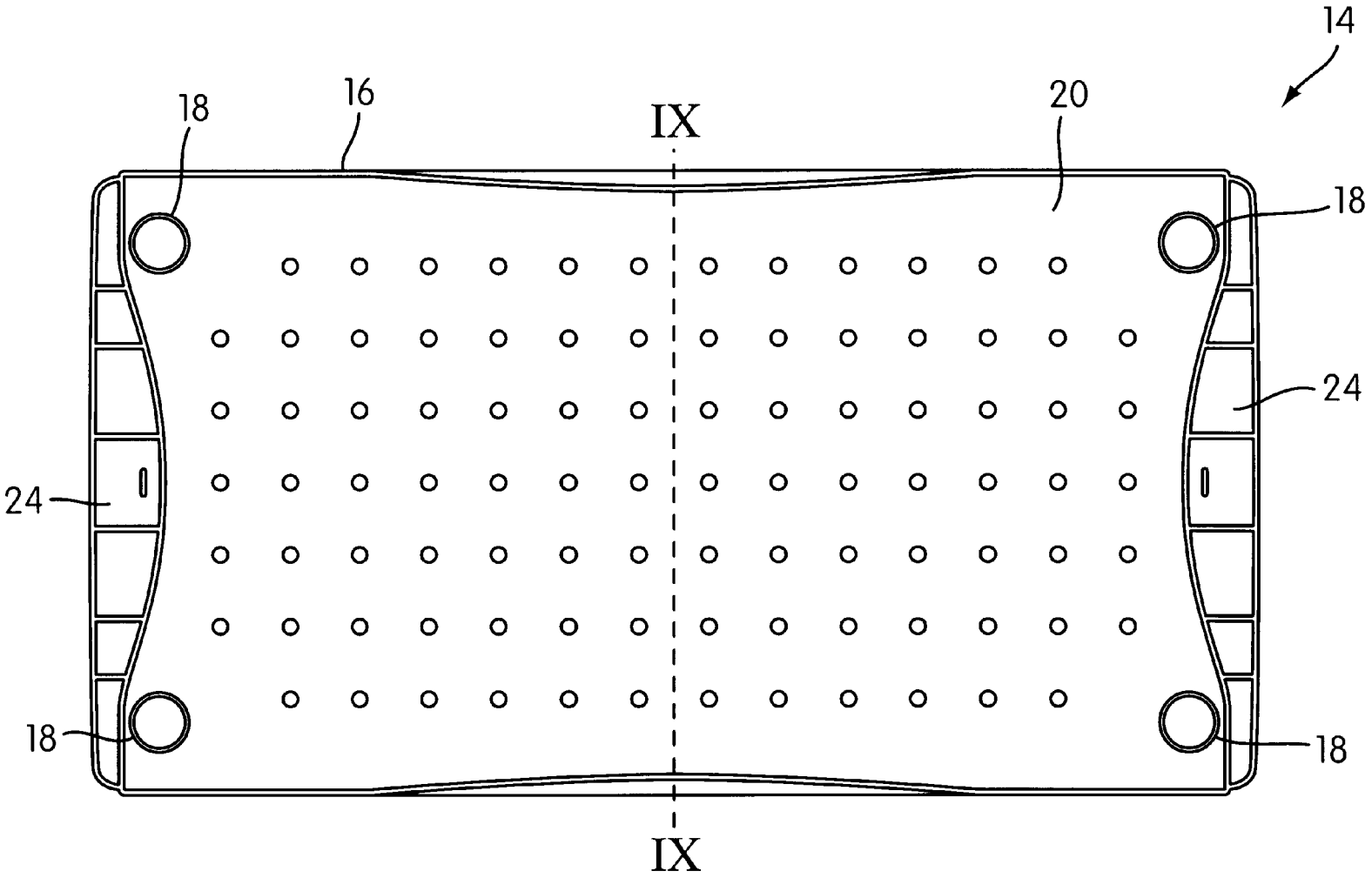
FIG. 2 is a plan view of a shelf assembly from the shelving system of FIG. 1.

Turning now to the details of shelving system 10 in more detail, FIG. 2 shows a shelf assembly 14 viewed from above. Upper surface 20, shown here with small ventilation apertures, may have any desired pattern of apertures, ranging from an open lattice to a continuous closed surface. The surface itself may be smooth or textured, and a rim may be provided. The surface may also support a secondary structure such as, for example, the bottle rack shown on the lowest shelf of FIG. 1.

Figure 3:
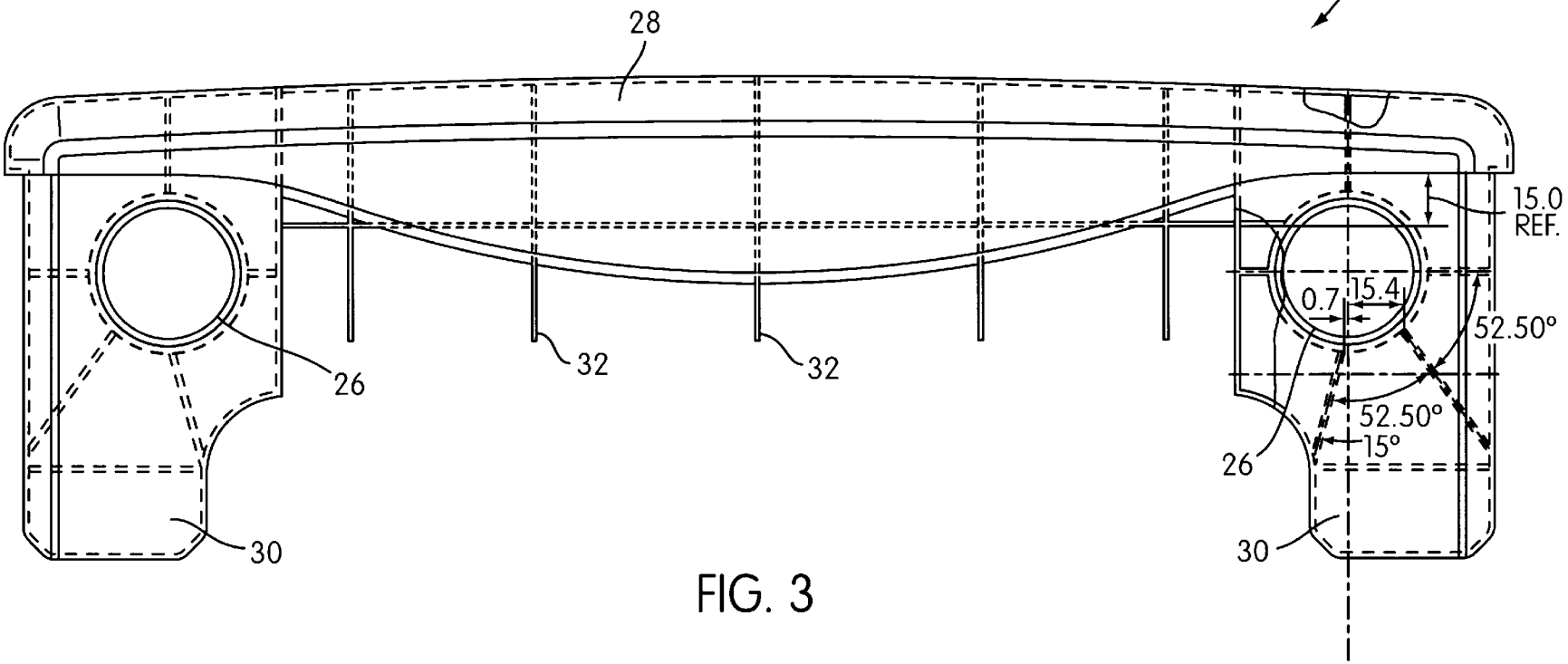
FIG. 3 is a plan view of a suspension insert from the shelf assembly of FIG. 2.

The structure of a suspension inserts 24 is shown in FIG. 3. An outer casing 28 is shaped to complement the outer dimensions and contours of shelf 16 to form the visible ends of an attractive closed shelf assembly when assembled. Extending from casing 28 are two plug elements 30 which are shaped to engage within open ends 22 of shelves 16. Additional ribs 32 also extend from casing 28 to provide support to the upper surface 20. Optionally, a resilient catch structure (not shown) may be provided for retaining suspension insert in engagement with open ends 22.

Vertical bores 26 are produced with one of two possible configurations, a first for forming an adjustable suspension joint, and a second for forming a fixed suspension joint. A typical implementation of shelving system 10 features a number of fixed shelves and a number of adjustable shelves. The numbers of each arc dictated by the number of suspension inserts 24 provided with each type of vertical bore.

Figure 4:
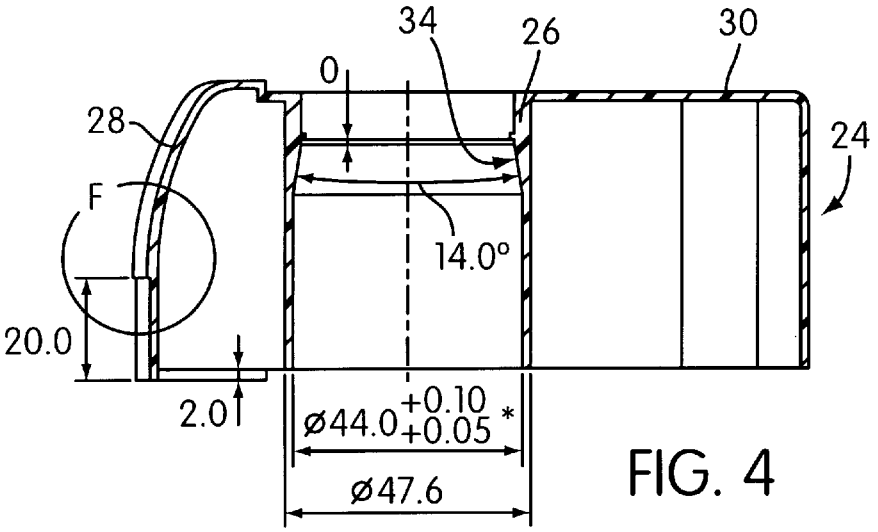
FIG. 4 is a cross-sectional view through a vertical bore of a first implementation of the suspension insert of FIG. 3 for forming an adjustable suspension joint.
Figure 5:
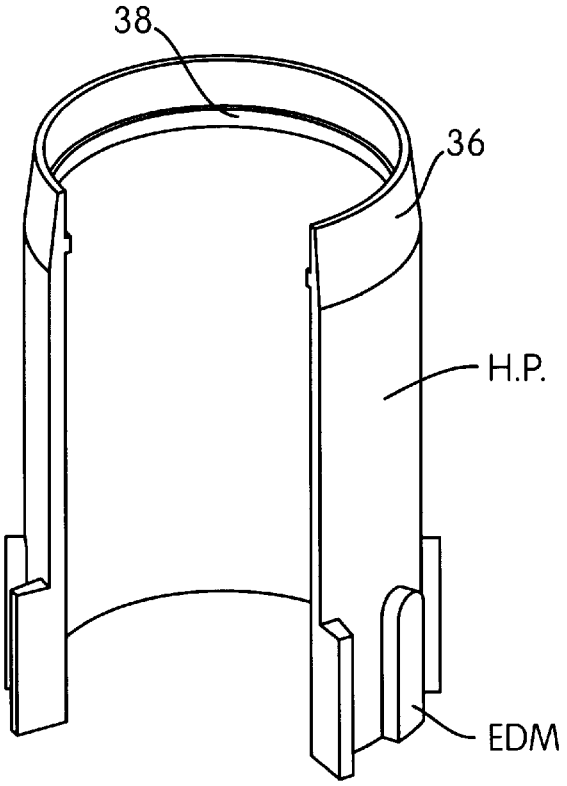
FIG. 5 is an isometric view of a locking element for use with suspension insert of FIG. 4.
Figure 6A:
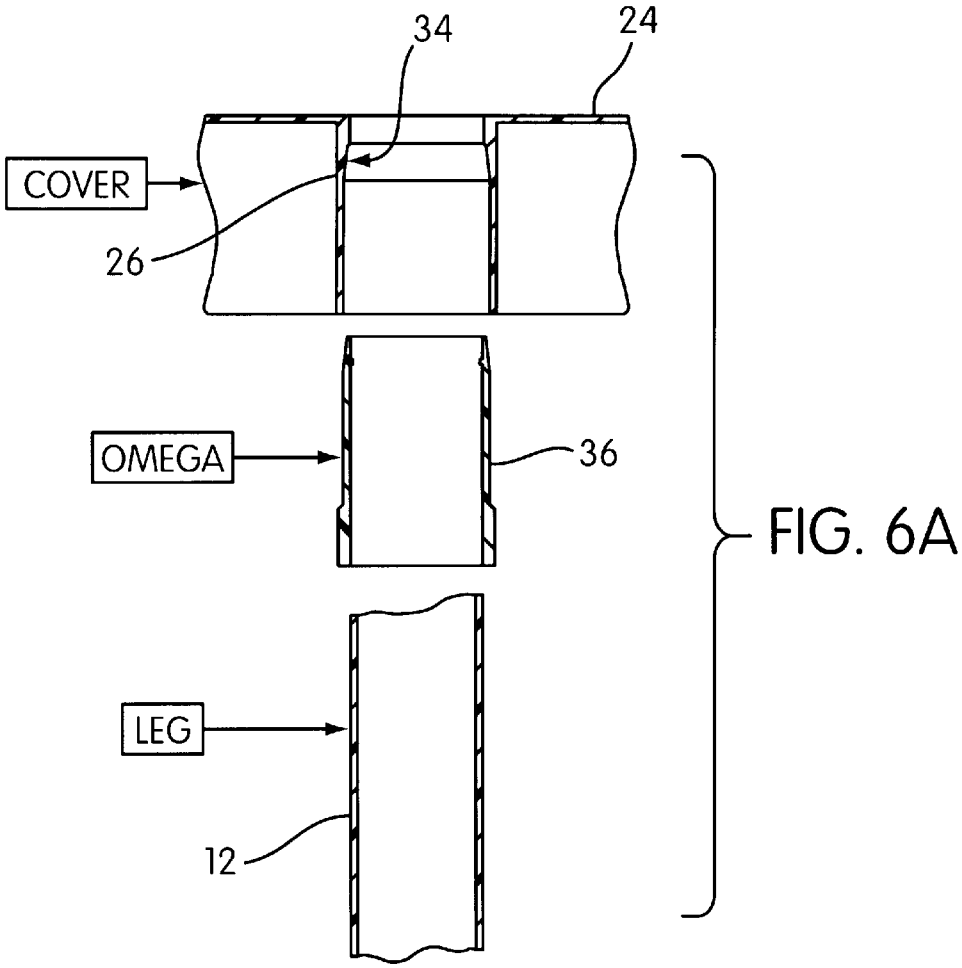
FIG. 6A is an exploded cross-sectional view of an adjustable suspension joint.
Figure 6B:
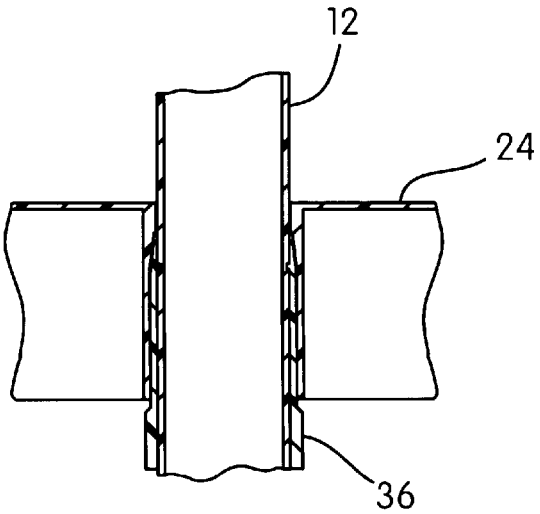
FIG. 6B is an assembled cross-sectional view of an adjustable suspension joint.

The structure of vertical bore 26 for forming an adjustable suspension joint is illustrated in FIG. 4. Here, bore 26 is formed with a substantially conical internal surface 34 along a part of its length. This structure is used in conjunction with a snap-on retaining element 36 as shown in FIG. 5. Retaining element has an inwardly projecting ridge 38 which is configured to engage corresponding circular indentations around support rods 12. Part of the outer surface of retaining element 36 has an upward-facing conical surface complementing conical internal surface 34. FIGS. 6A and 6B illustrate the assembly of the adjustable suspension joint. First retaining element 36 is clipped into place engaging an indentation at the desired height on support rods 12. Then, the shelf assembly is lowered onto the retaining element until internal surface 34 wedges onto the conical surface of retaining element 36, trapping the retaining element between bore 26 and support rods 12.

Figure 7:
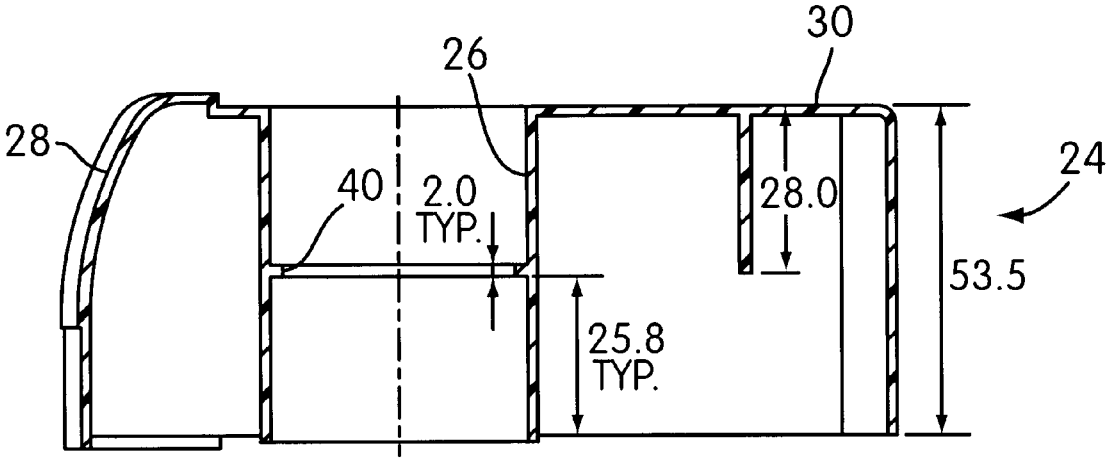
FIG. 7 is a cross-sectional view through a vertical bore of a second implementation of the suspension insert of FIG. 3 for forming a fixed suspension joint.

FIG. 7 illustrates the structure of vertical bore 26 for forming a fixed suspension joint. Here, an inwardly projecting ridge 40, equivalent to ridge 38, is formed as an integral part of the inner surface of bore 26. Shelf assemblies having this configuration of bore 26 are engaged between adjacent sections of support rods 12 at desired positions during initial assembly of the rods.

Figure 8:
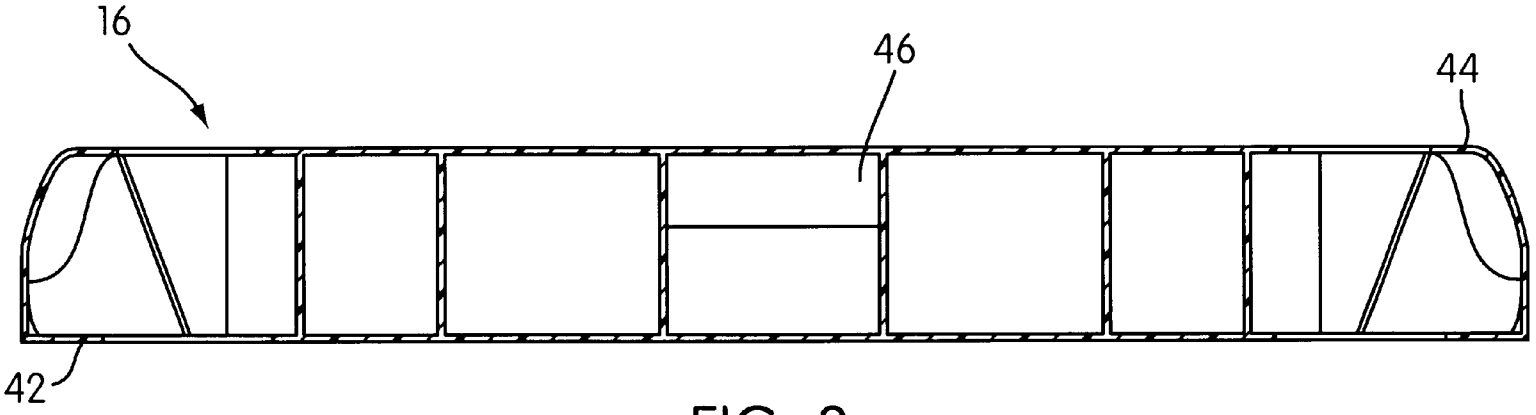
FIG. 8 is an end view of the shelf of FIG. 2 with the suspension insert removed.
Figure 9:
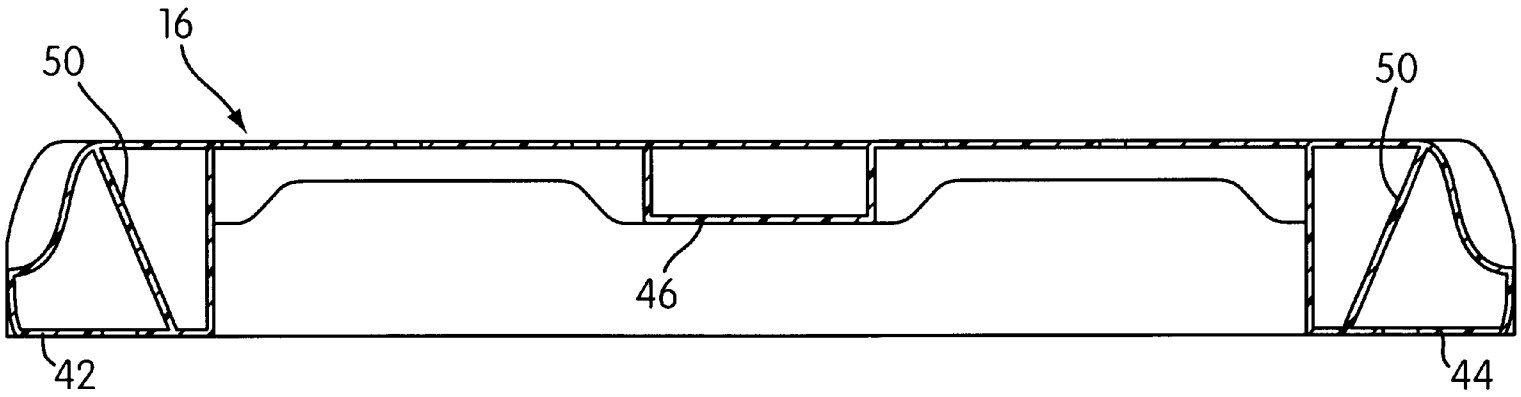
FIG. 9 is a transverse cross-sectional view through the shelf of FIG. 2 taken along the line IX—IX.

As mentioned above, shelves 16 are preferably formed with hollow supports of closed cross-section extending substantially continuously between open ends 22. The structure of these supports is best seen in FIGS. 8 and 9.

Figure 10:
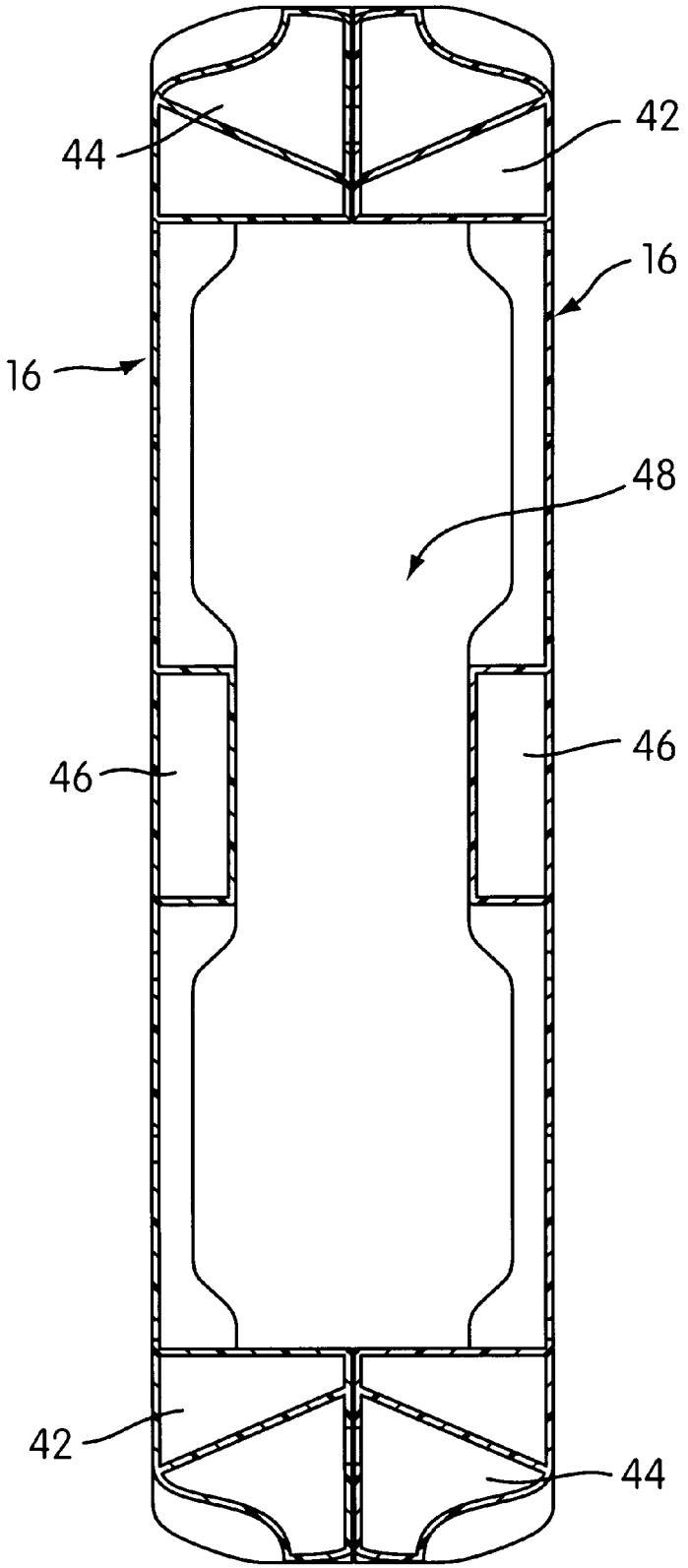
FIG. 10 is a view similar to FIG. 9 showing two similar shelves positioned together for packaging.
Figure 11:
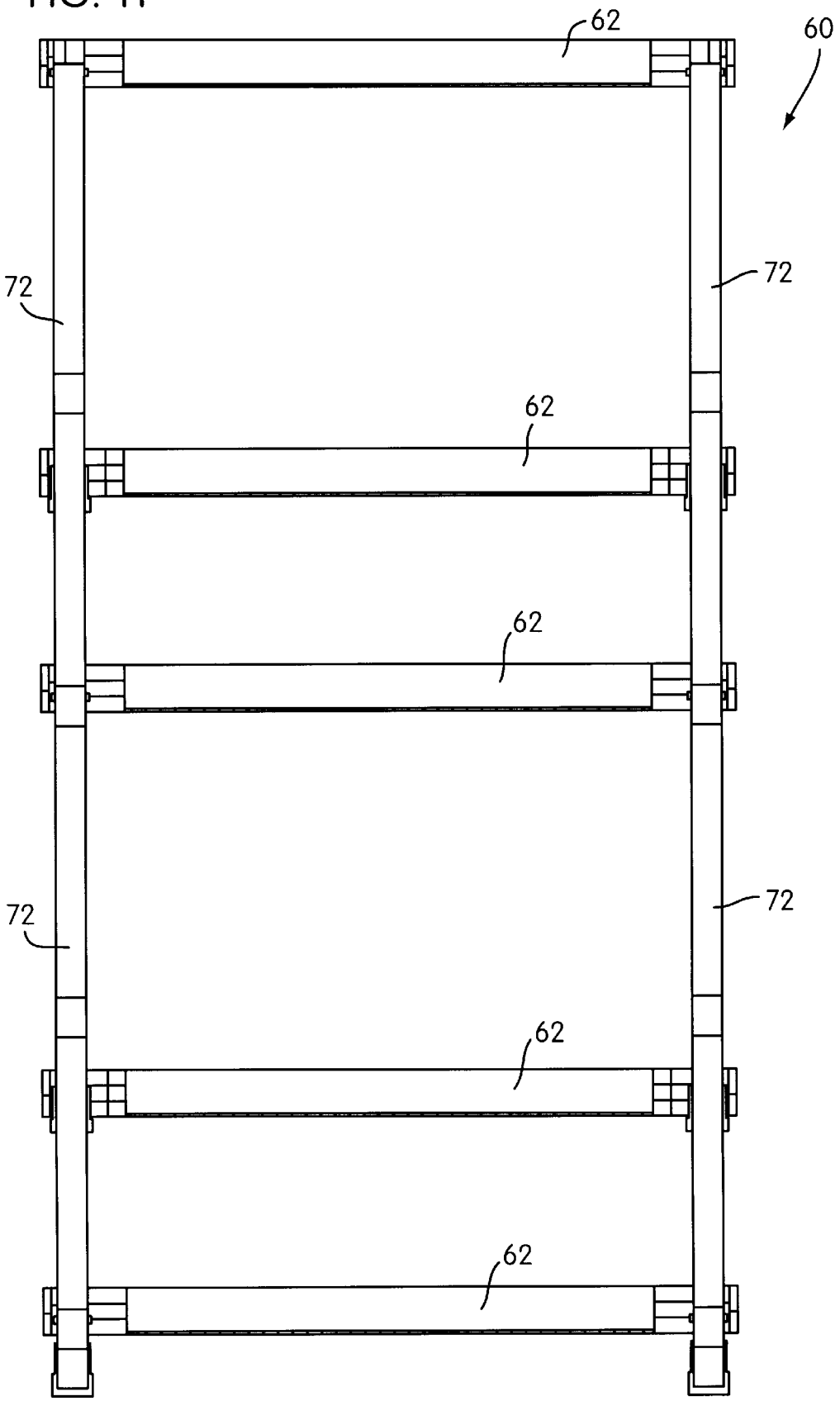
FIG. 11 is a front cross-sectional view of a second embodiment of a shelving system, constructed and operative according to the teachings of the present invention.
Figure 12A:
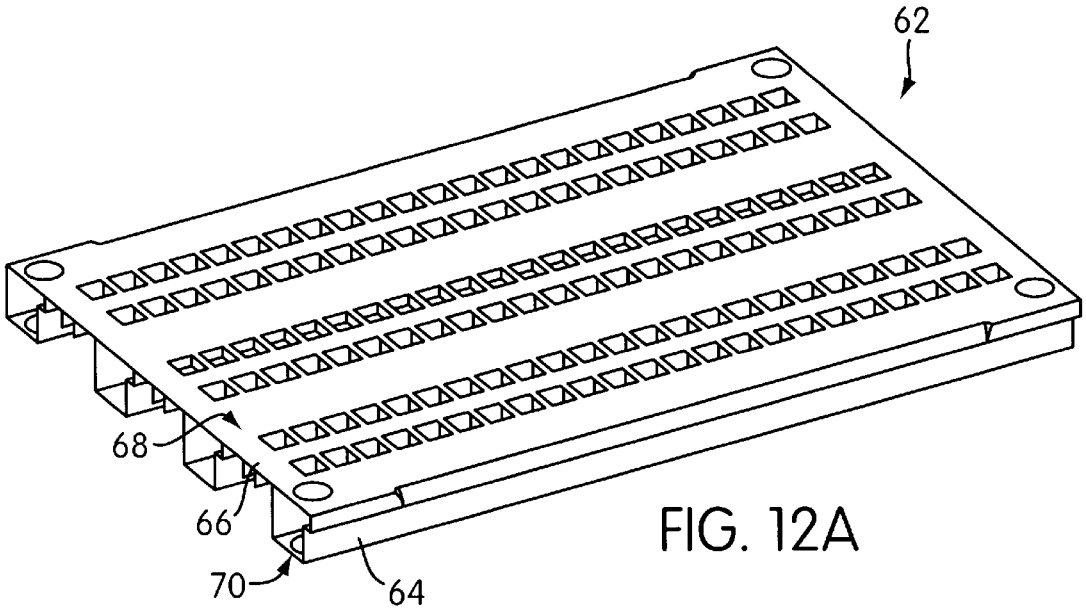
FIGS. 12A and 12B are top and bottom isometric views, respectively, of a shelf from the embodiment of FIG. 11.
Figure 12B:
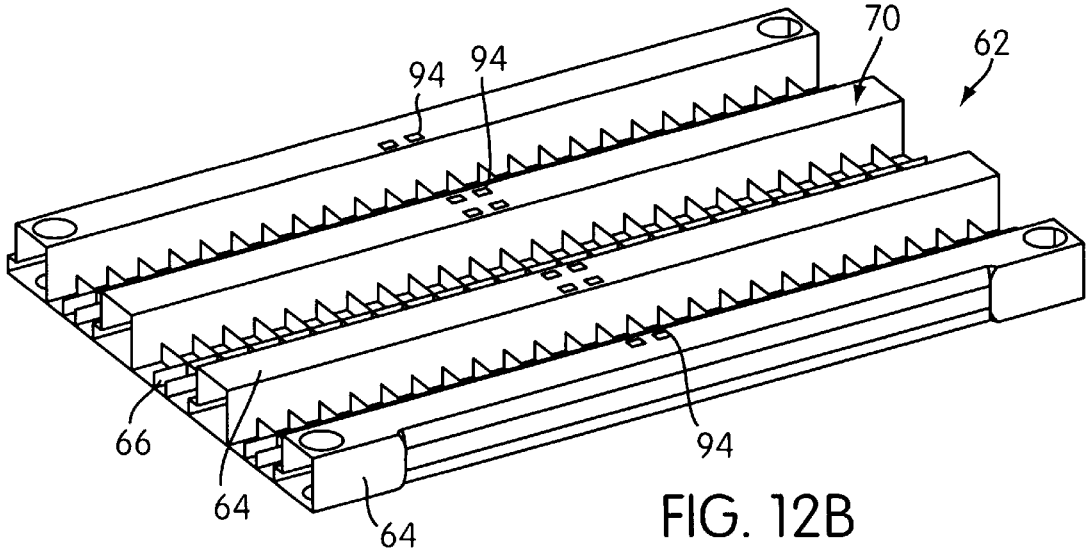

Each shelf 16 typically features at least three such supports including a front support 42, a rear support 44, and at least one intermediate support 46. The primary support is provided by the front and rear supports 42 and 44 which, together with suspension inserts 24, for a strong outer frame. Intermediate supports 46 preferably have a depth of less than about half of the depth of the front and rear supports. This latter feature allows particularly compact packaging of shelving system 10, dissembled support rods and other accessories being stored in the cavities 48 between juxtaposed shelves as shown in FIG. 10.

The hollow supports are described as extending "substantially continuously" between open ends 22. In this context, it should be noted that the supports may be interrupted by a solid transverse wall at or near the middle of their length. Furthermore, although the supports arc preferably of closed cross-section right up to open ends 22, this is not necessarily so.

Similarly, it should be understood that the closed cross-section referred to need not be uniform along the length of the supports. Thus, in the examples shown here, both internal and external features of front and rear supports 42 and 44 vary along their length.

Specifically, an intermediate portion of front and rear supports 42 and 44 is formed with an internal wall 50, extending along the direction of extension of the hollow supports, which subdivides the closed cross-section. This adds extra rigidity in the portion of the shelf furthest from support rods 12. In addition, the presence of symmetrical longitudinal grooves in the extremities of the elongated mold parts used to form the hollow supports helps maintain alignment of the mold parts during injection.

A further feature of the intermediate portion is that the area of the closed cross-section varies along the length of front and rear supports 42 and 44 having a larger value adjacent to open ends 22 than within the intermediate portion. This can be seen from the different cross-sectional shapes of front and rear supports 42 and 44 viewed in FIGS. 8 and 9, forming a recessed intermediate portion of the outer edge of the shelf as seen in the top view of FIG. 2.

With reference to FIGS. 11–21, a second embodiment of a shelving system according to the present invention will now be described. The shelving system, generally designated 60, is similar to shelving system 10 described above, but provides a number of additional features for minimizing the volume of a storage state of the system. In all respects other than those described below, the features, construction and materials used in shelving system 60 may be understood by analogy with those of system 10.

Figure 13:
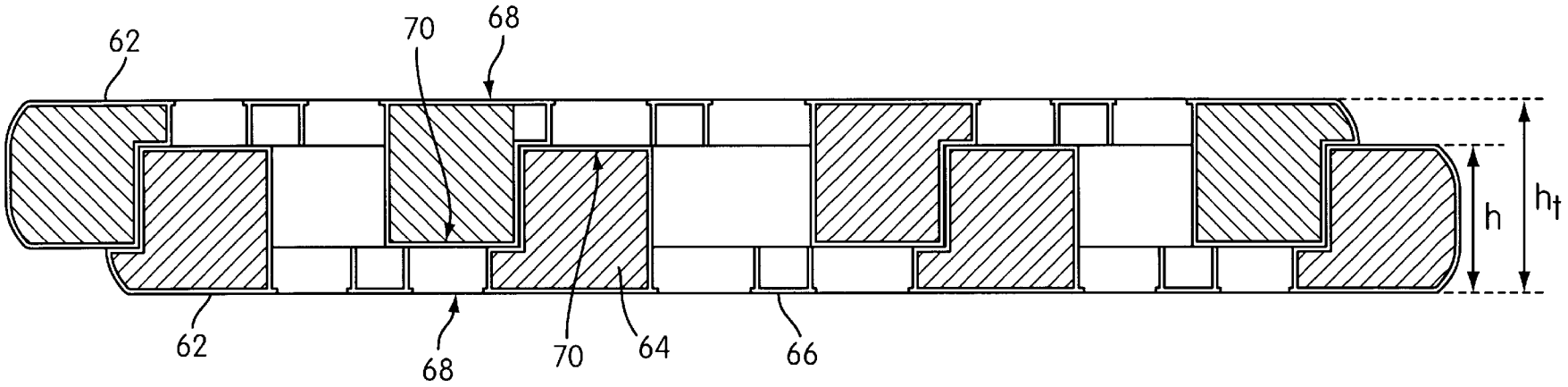
FIG. 13 is a side view of a pair of shelves from the embodiment of FIG. 11 in a compact interlocked storage configuration.

Firstly, shelving system 60 has a number of shelves 62 of molded polymer material. Each shelf 62 has at least two hollow support ribs 64 extending parallel to, and along substantially the entirety of, the width of the shelf, and at least one intermediate platform portion 66 connecting between the support ribs. Each of the hollow support ribs has a height h defined as the distance from the plane of the upper surface 68 of shelf 62 to the lower surface 70 of support rib 64. Intermediate platform portion 66 has a height significantly less than h, preferably less than about h/2 and typically no more than about h/3. Additionally, the spacing between adjacent support ribs 64 is at least as great as the breadth of the ribs. This structure allows two such shelves to be positioned in an interlocking storage configuration as shown in FIG. 13 in which at least one of support ribs 64 of one shelf is adjacent to the intermediate platform portion 66 of the other to form a compact shelf-pair package having a total height h, between the two upper surfaces 68 of less than 2×h. Depending on the relative heights of support ribs 64 and intermediate platform portions 66, the total height h, is preferably less than about 1.5×h, and typically less than about 1.3×h.

It should be noted that the word "interlocking" as used in relation to the storage configuration of shelves 62 is used to refer to a configuration in which projecting portions of one element lie in the recesses between projecting portions of another element. It is not intended to imply either a close matching between the shapes or locking engagement between the elements.

Shelving system 60 also includes a number of rods 72 for supporting shelves 62 in spaced relation. In order to achieve a further reduction in storage size, the internal cavity of at least one, and typically all, of hollow support ribs 64 is designed to receive rod 72 inserted in a storage position within the elongated cavity (see FIG. 19). in a simple implementation, the elongated internal cavity of support rib 64 extends along its entire length. In this case, rod 72 can pass freely through hollow support rib 64. Alternatively, the internal cavity of the support rib may feature an internal stop, for example, an off-center equivalent of transverse wall 50, positioned so as to delimit a fully inserted storage position of rod 72 within support ribs 64 so that the rod extends slightly therefrom. In this context, "extending slightly" is used to mean extending sufficiently to allow the rod to be grasped manually and withdrawn, typically at least a few millimeters, and is limited to not more than about 5% of the length of the rod.

Figure 14A:
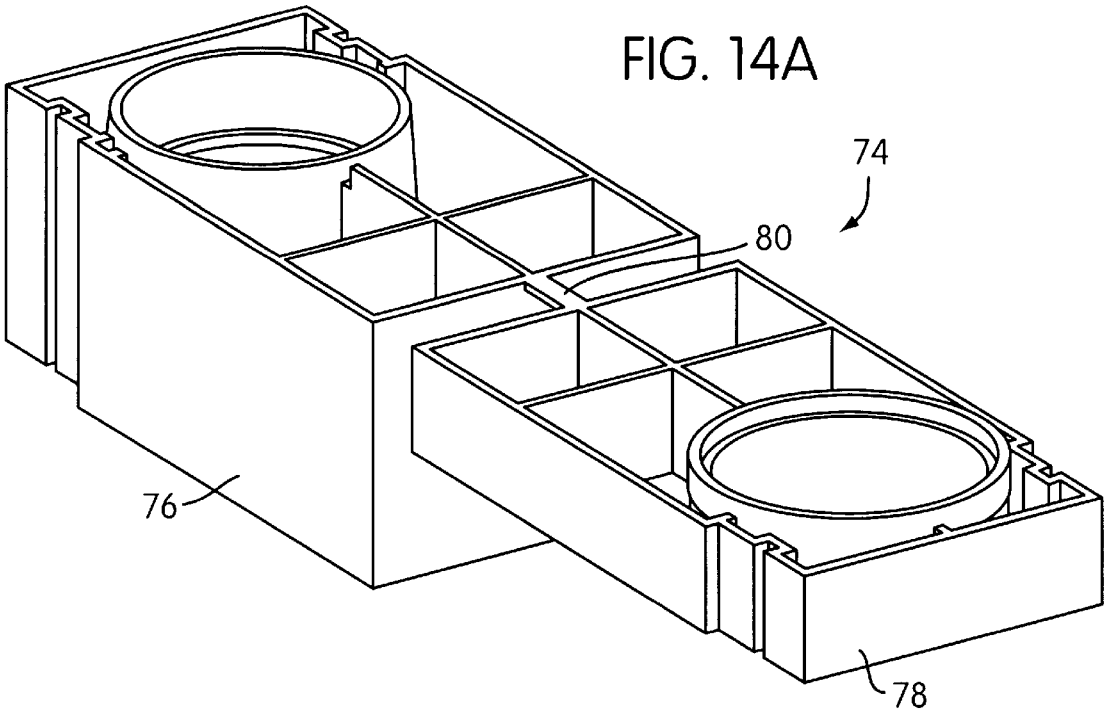
FIGS. 14A and 14B are isometric views of a compound plug element for use in the embodiment of FIG. 11, the element being shown with two sections in substantially separated and interconnected configurations, respectively.
Figure 14B:
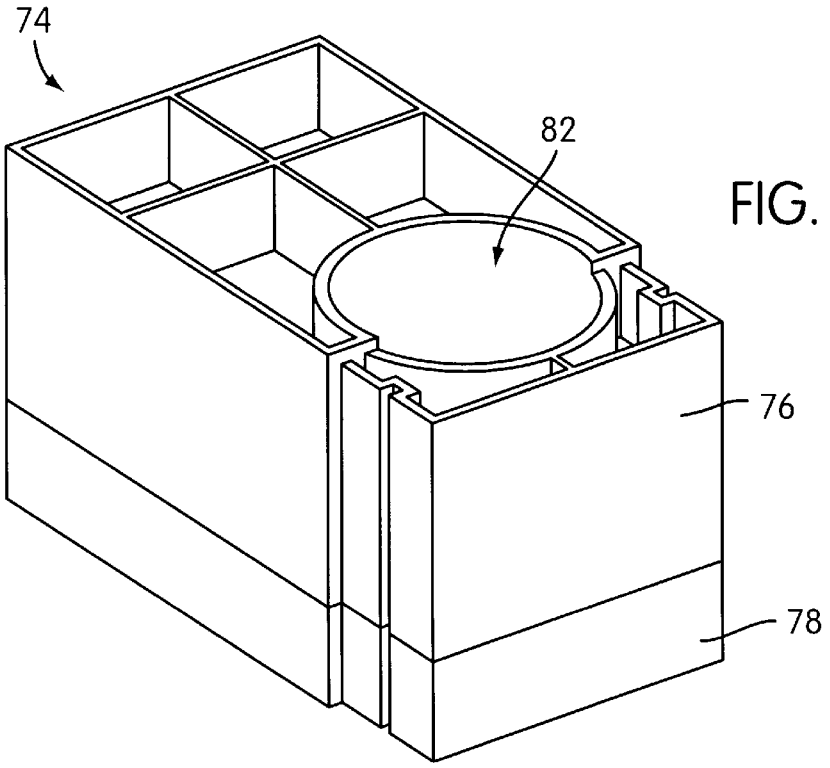

A further space saving in the storage configuration is achieved by replacing the suspension insert 24 of shelving system 10 with a modular cover unit which is assembled from modules which fit within openings in the stacked shelves. Thus, FIGS. 14A and 14B show a compound plug element 74 formed from at least two plug sections 76 and 78. Plug sections 76 and 78 assume a substantially separated state (FIG. 14A) for compact storage and an interconnected state (FIG. 14B) in which they form a unitary plug element configured for engaging an open end of one of hollow support ribs 64. Preferably, for ease of use, plug sections 76 and 78 arc integrally formed from molded polymer material so as to connected by an integral hinge element 80 in their substantially separated state.

Each compound plug element 74 is preferably configured to provide a bore 82 adapted for either a fixed or adjustable suspension joint as described above with reference to FIGS. 4–7 above. Here too, at least some of support ribs provide openings through their upper and lower surfaces adjacent to ends of the shelf with which bore 82 aligns when compound plug element 74 is engaged within the rib.

Figures 15A, 15B:
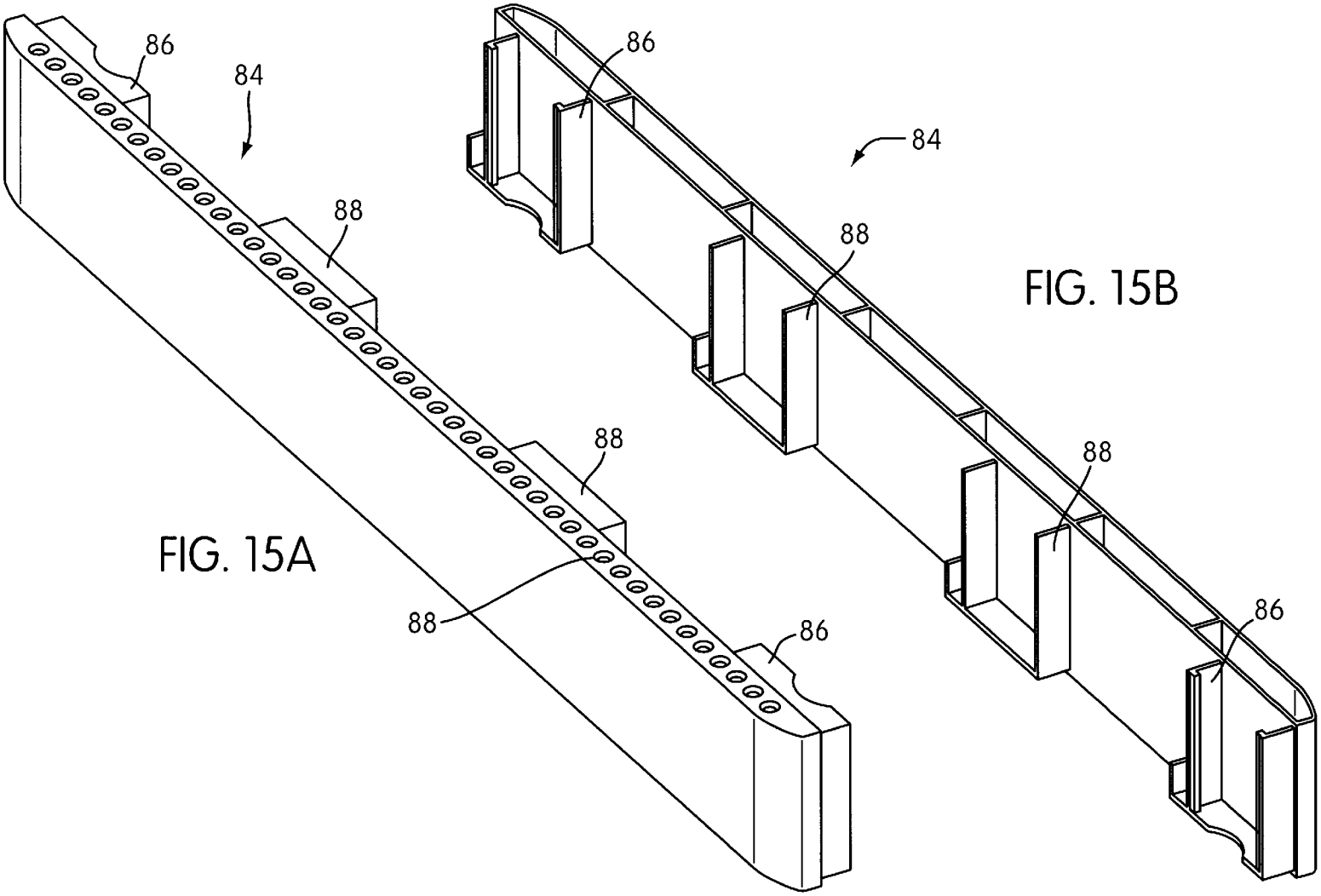
FIGS. 15A and 15B are top and bottom isometric views of a side cover element for use with the shelves of the embodiment of FIG. 11.
Figure 16:
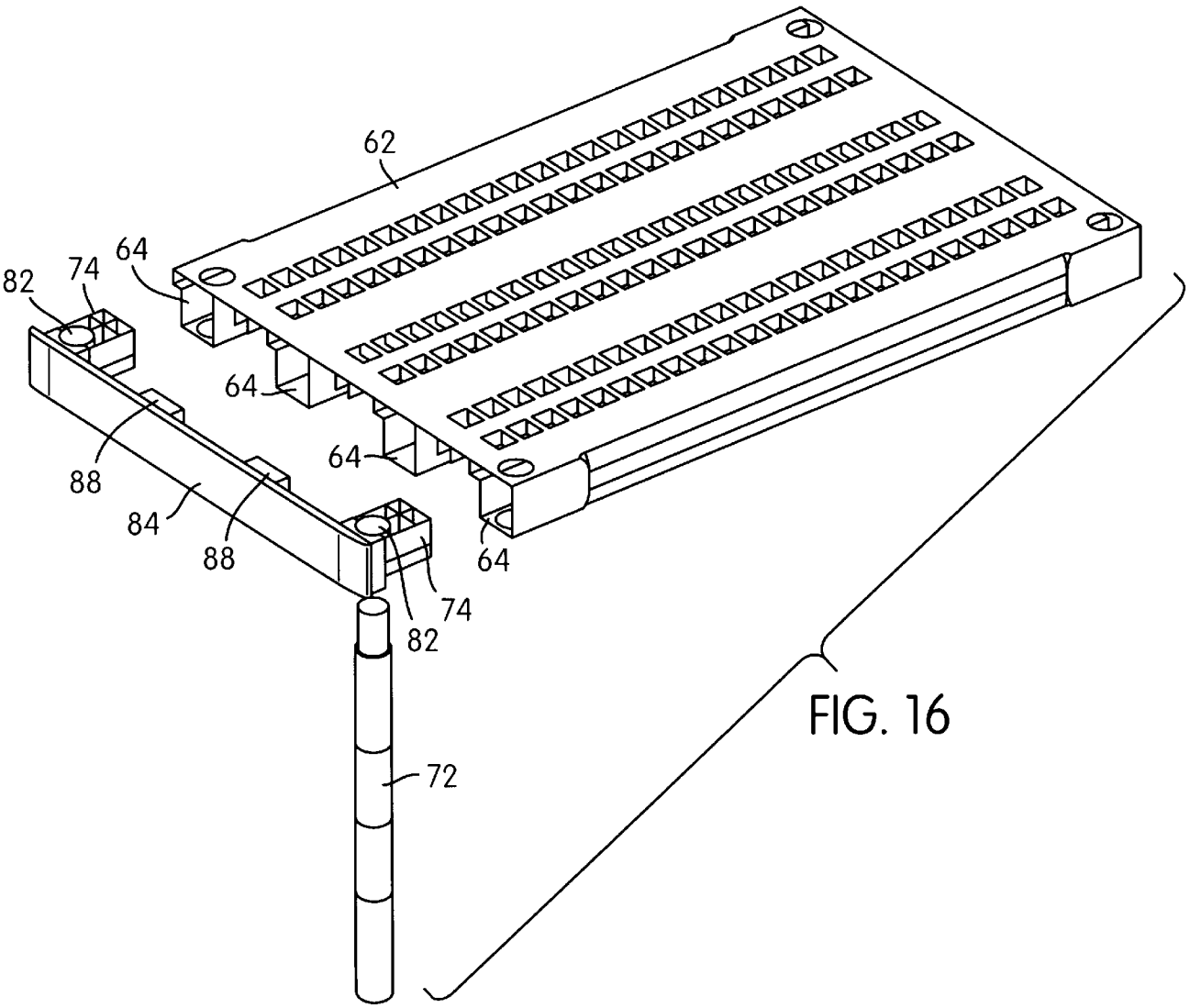
FIG. 16 is a dissembled isometric view showing the construction of a shelf unit from the shelf, plug element and side cover of FIGS. 12–15.

FIGS. 15A and 15B show a side cover element 84 with snap-in or slide-in sockets 86 for receiving at least two compound plug elements 74 and projections 88 for engaging any other support ribs 64 directly. Side cover element 84 together with the attached compound plug elements 74 form a cover unit functionally equivalent to suspension insert 24 described above for attaching to a side of shelf 62 as shown in FIG. 16. Optionally, cover element 84 may feature a number of accessory holes 90 (FIG. 15A) for hanging various accessories from the sides of the assembled shelves.

Figure 17:
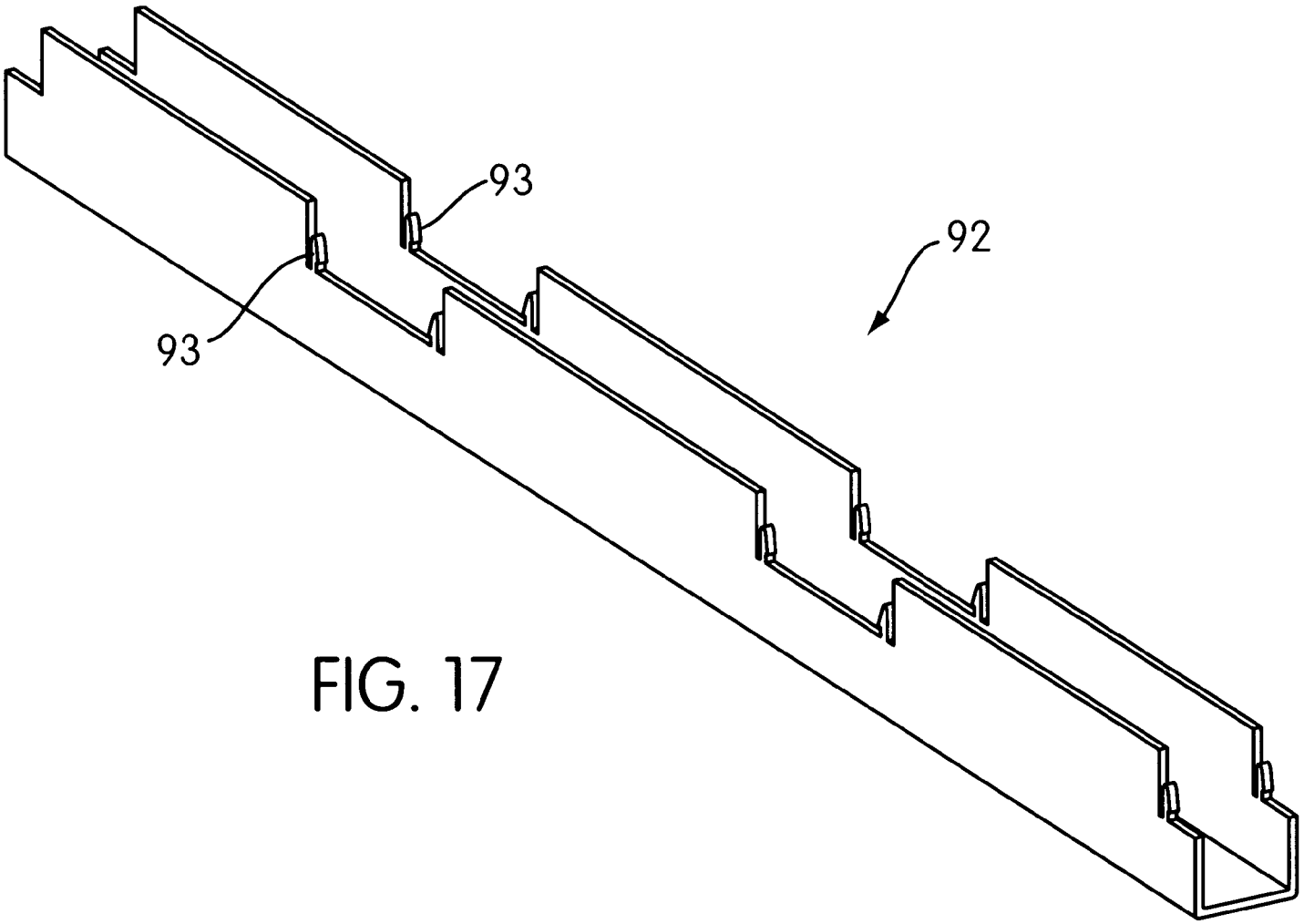
FIG. 17 is an isometric view of a reinforcing element for use with the shelves of the embodiment of FIG. 11.
Figure 18:
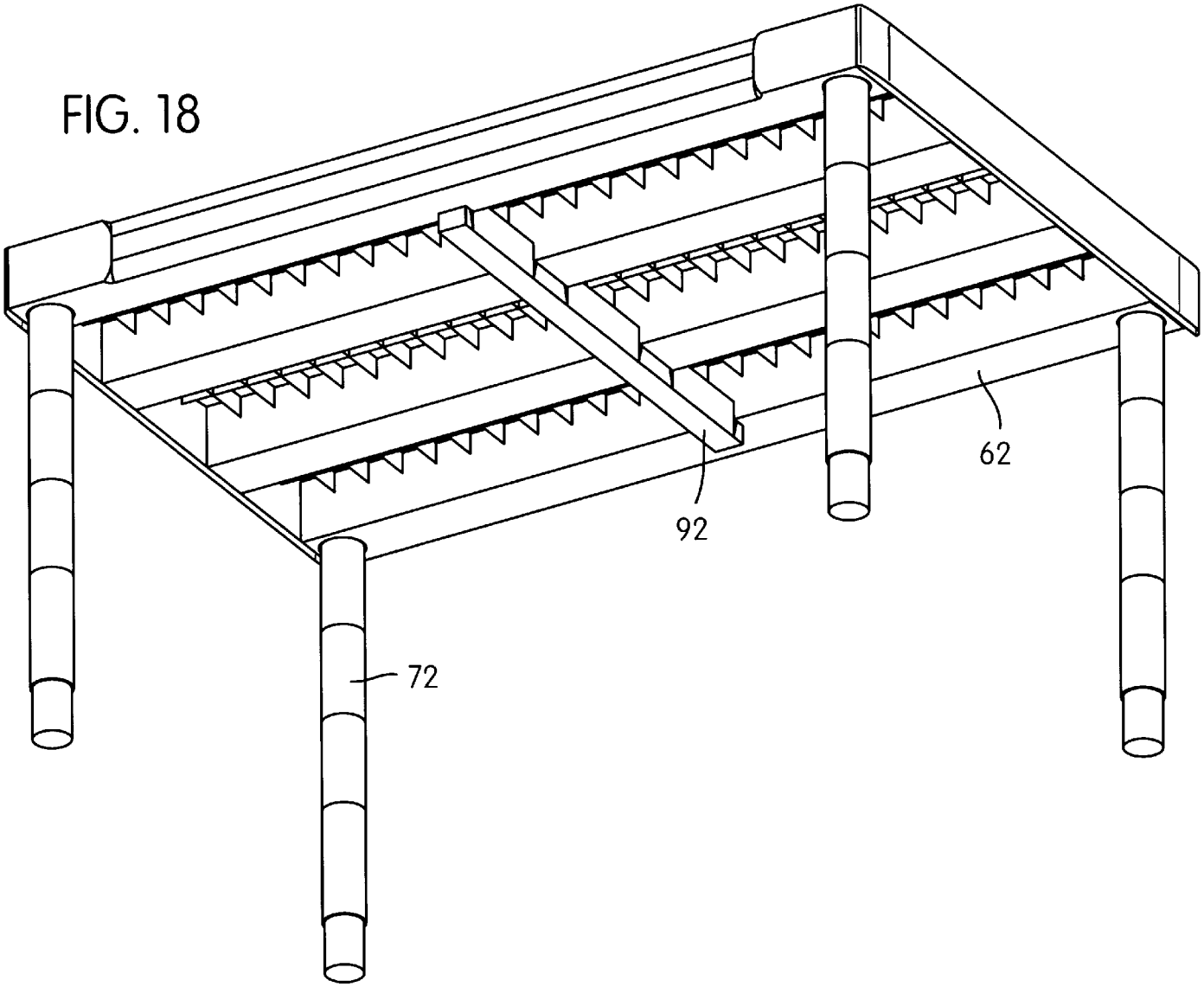
FIG. 18 is a bottom isometric view of part of the shelving system of FIG. 11 showing the attachment of the reinforcing element of FIG. 17.

Turning now to FIGS. 17 and 18, there is shown a reinforcing element 92 for use with shelf 62 in high load applications. The inherent structure of shelf 62 provides high resistance to bending along the extensional direction of support ribs 64, but is less strong in a transverse direction.

Near the ends of the shelf, the side cover unit structure provides considerable rigidity in this transverse direction. However, particularly for larger shelves, additional reinforcement may be desired. Reinforcing element 92 provides the required reinforcement without interfering with the compact storage configuration of shelving system 60.

Reinforcing element 92 is configured for attachment between the lower surfaces of at least two of support ribs 64 in a direction perpendicular to the extensional direction of the support ribs so as to oppose increase of a distance between the support ribs. In the implementation shown here, reinforcing element 92 has a stepped profile shaped to mate with the lower portion of the intermediate support ribs 64. Reinforcing element 92 is held in place and grips the outermost support ribs through a number of barbed projections 93 which engage corresponding holes 94 (FIG. 12B) in support ribs 64. In this example, reinforcing element 92 is shown as a U-section beam, although many other forms are possible.

Figure 19:
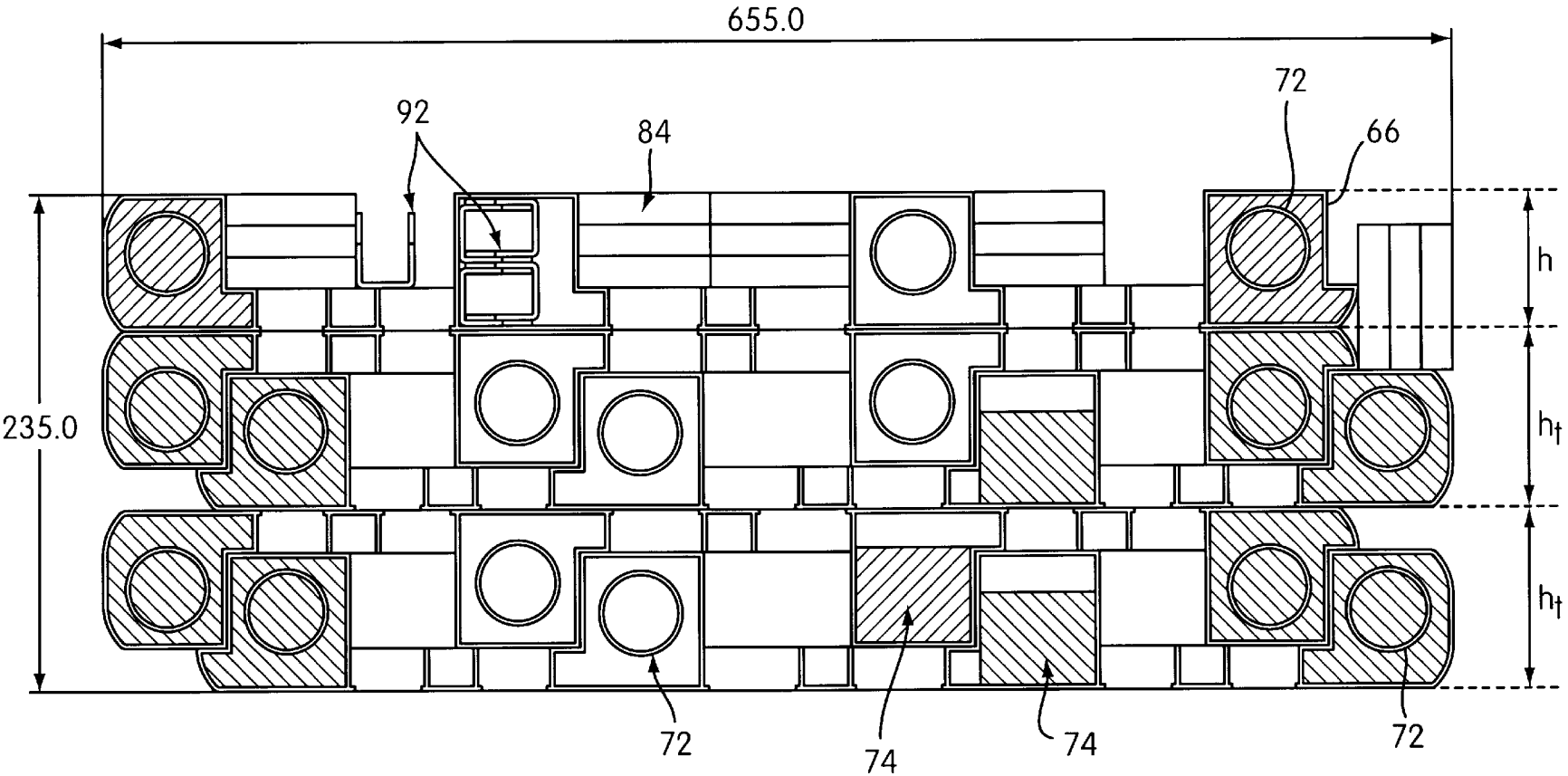
FIG. 19 is a side view of the shelving system of FIG. 11 in a compact storage configuration.

Turning now to FIG. 19, the sum total of the features described above allows the entirety of 5-shelf shelving system 10 to be enclosed in a rectangular package of height considerably less than 4×h. The width of the package is the same as the width of an individual shelf and the length is greater than the front-to-back dimension of the shelf by about the width of one support rib.

Figure 20A:
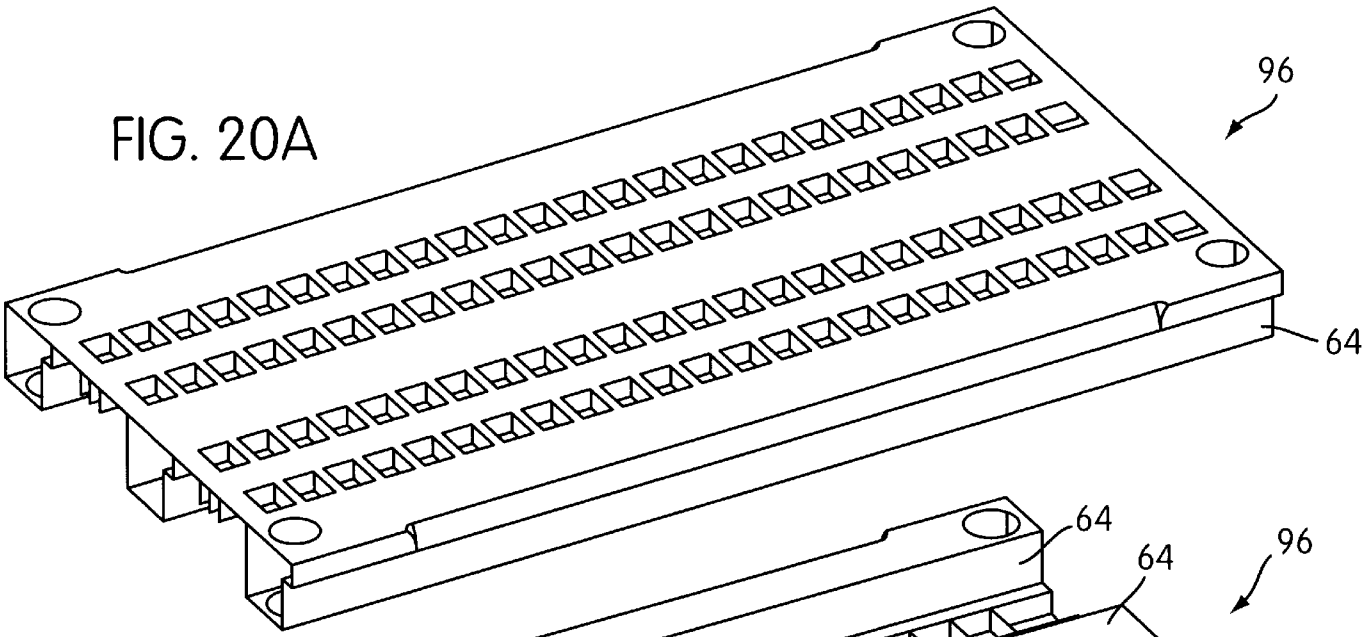
FIGS. 20A and 20B are top and bottom isometric views, respectively, of an alternative implementation of a shelf for a variant of the embodiment of FIG. 11.
Figure 20B:
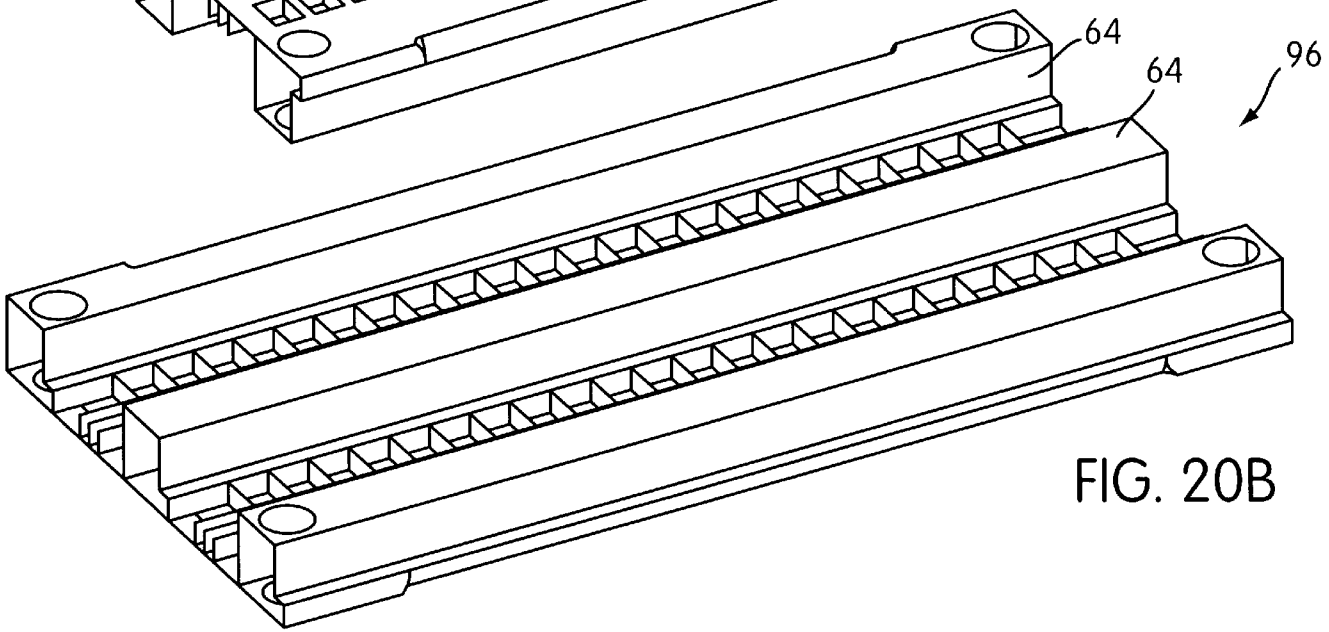
Figure 21:
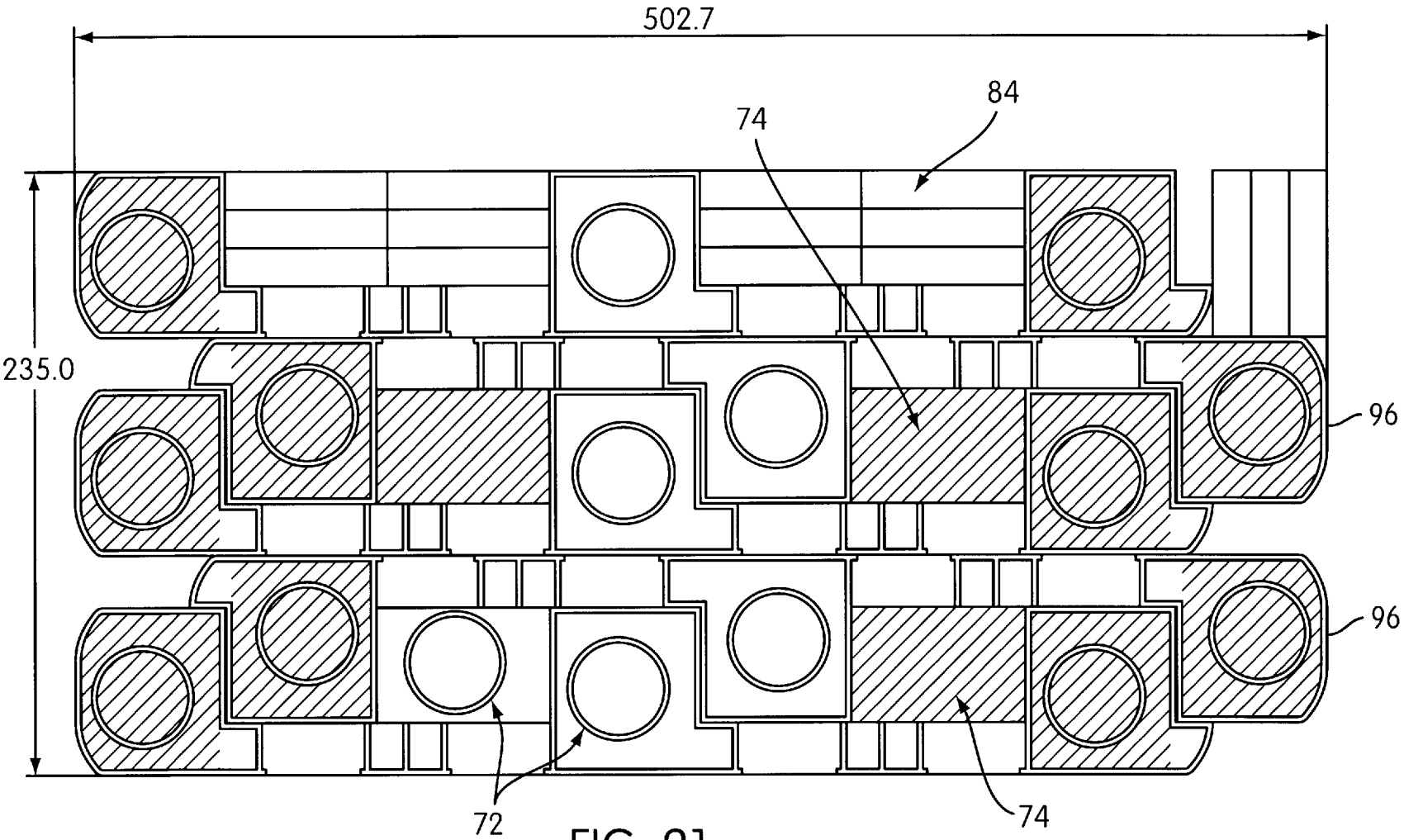
FIG. 21 is a side view of the shelving system of FIG. 11 in a compact storage configuration.

Finally, with brief reference to FIGS. 20–21, it should be noted that the number of support ribs, proportions and various other features of the shelving system may be varied without departing from the scope of the present invention. By way of example, FIGS. 20A and 20B show an alternative shelf 96 formed with three support ribs 64. Other features such as the side cover element structure are correspondingly adapted. FIG. 21 shows the corresponding storage configuration for this shelf structure.

It will be appreciated that the above descriptions are intended only to serve as examples, and that many other embodiments are possible within the spirit and the scope of the present invention.

What is claimed is:

1. A shelving system adapted for compact packaging comprising a plurality of shelves of molded polymer material, each of said shelves having at least two hollow support ribs extending parallel to, and along substantially the entirety of, a width of said shelf, said hollow support ribs having a height h, each of said shelves further including at least one intermediate platform portion connecting between said support ribs, said at least one intermediate platform portion having a height significantly less than h such that a first shelf and a second shelf from said plurality of shelves can be positioned in an interlocking storage configuration in which at least one of said support ribs of said first shelf is adjacent to said intermediate platform portion of said second shelf so as to form a compact shelf-pair package having a total height less than 2×h.

2. The shelving system of claim 1, wherein said total height is less than about 1.5×h.

3. The shelving system of claim 1, wherein said total height is less than about 1.3×h.

4. The shelving system of claim 1, further comprising a plurality of rods for supporting said plurality of shelves in spaced relation, at least one of said hollow support ribs of each of said shelves having an elongated internal cavity, said elongated internal cavity and said rods being configured such that each of said rods can be introduced into said elongated cavity to a storage position in which said rod is substantially fully inserted within said elongated internal cavity.

5. The shelving system of claim 4, wherein said elongated internal cavity of at least one of said hollow support ribs of at least one of said shelves extends along the entire length of said at least one hollow support rib such that one of said rods can pass freely through said at least one hollow support rib.

6. The shelving system of claim 4, wherein said rods have a length, said elongated internal cavity of at least one of said hollow support ribs of at least one of said shelves having an internal stop deployed so as to delimit a fully inserted storage position of one of said rods within said at least one hollow support rib such that said one of said rods extends slightly from said at least one hollow support rib.

7. The shelving system of claim 1, further comprising, for each of said shelves, a plurality of compound plug elements, each of said compound plug elements being formed from at least two plug sections which assume a substantially separated state for compact storage and an interconnected state configured for engaging an open end of one of said hollow support ribs.

8. The shelving system of claim 7, wherein said at least two plug sections of at least one of said compound plus elements are integrally formed from molded polymer material so as to be connected by an integral hinge element in said substantially separated state.

9. The shelving system of claim 7, further comprising a number of side cover elements each configured to receive at least two of said compound plug elements so as to form a cover unit for attaching to a side of one of said shelves.

10. The shelving system of claim 7, wherein at least two of said support ribs of at least one of said shelves provide openings through an upper surface of said at least one shelf adjacent to ends of said at least one shelf, each of said compound plug elements having a vertical bore configured so as to be aligned with one of said openings when one of said compound plug elements is engaged within an open end of one of said hollow support ribs of said at least one shelf.

11. The shelving system of claim 1, further comprising a reinforcing element configured for attachment between the lower surfaces of at least two of said support ribs in a direction perpendicular to the extensional direction of said support ribs.

12. The shelving system of claim 11, wherein said reinforcing element features a plurality of barbed projections for engaging corresponding holes in said support ribs.

13. A shelving system adapted for compact packaging comprising:

(a) a plurality of shelves of molded polymer material, each of said shelves having at least two hollow support ribs extending parallel to, and along substantially the entirety of, a width of said shelf, at least one of said hollow support ribs of each of said shelves having an elongated internal cavity, and at least one intermediate platform portion connecting between said support ribs; and (b) a plurality of rods for supporting said plurality of shelves in spaced relation, wherein said elongated internal cavities and said rods are configured such that each of said rods can be introduced into a storage position in which said rod is substantially fully inserted within one of said elongated internal cavities.

14. The shelving system of claim 13, wherein said elongated internal cavity of at least one of said hollow support ribs of at least one of said shelves extends along the entire length of said at least one hollow support rib such that one of said rods can pass freely through said at least one hollow support rib.

15. The shelving system of claim 13, wherein said rods have a length, said elongated internal cavity of at least one of said hollow support ribs of at least one of said shelves having an internal stop deployed so as to delimit a fully inserted storage position of one of said rods within said at least one hollow support rib such that said one of said rods extends slightly from said at least one hollow support rib.

16. A shelving system adapted for compact packaging comprising:

(a) a plurality of shelves of molded polymer material, each of said shelves having at least two hollow support ribs extending parallel to, and along substantially the entirety of, a width of said shelf, and at least one intermediate platform portion connecting between said support ribs; and (b) for each of said shelves, a plurality of compound plug elements, each of said compound plug elements being formed from at least two plug sections which assume a substantially separated state for compact storage and an interconnected state configured for engaging an open end of one of said hollow support ribs.

17. The shelving system of claim 16, wherein said at least two plug sections of at least one of said compound plug elements are integrally formed from molded polymer material so as to be connected by an integral hinge element in said substantially separated state.

18. The shelving system of claim 16, further comprising a number of side cover elements each configured to receive at least two of said compound plug elements so as to form a cover unit for attaching to a side of one of said shelves.

19. The shelving system of claim 16, wherein at least two of said support ribs of at least one of said shelves provides an opening through an upper surface of said at least one shelf adjacent to ends of said at least one shelf, each of said compound plug elements having a vertical bore configured so as to be aligned with one of said openings when one of said compound plug elements is engaged within an open end of one of said hollow support ribs of said at least one shelf.

* * * * *